US005600609A

United States Patent [19]

Vacher

[11] Patent Number: 5,600,609

[45] Date of Patent: Feb. 4, 1997

[54] ABSORBENT PASSIVE ACOUSTIC ANTENNA

[75] Inventor: Patrick Vacher, Vence, France

[73] Assignee: Thomson-CSF, Paris, France

[21] Appl. No.: 450,634

[22] Filed: May 25, 1995

[30] Foreign Application Priority Data

May 31, 1994 [FR] France ..... 94 06601

[51] Int. Cl.[6] ..... H04R 17/00

[52] U.S. Cl. ..... 367/176; 367/162

[58] Field of Search ..... 367/131, 140, 367/162, 165, 176, 1; 310/326, 327, 337; 181/284, 290

[56] References Cited

U.S. PATENT DOCUMENTS

| | | | |
|---|---|---|---|
| 3,647,022 | 3/1972 | Meyer et al. | 181/290 |
| 3,894,169 | 7/1975 | Miller | 428/414 |
| 4,390,976 | 6/1983 | Eynck | 367/153 |
| 4,571,520 | 2/1986 | Saito et al. | 310/327 |
| 4,628,490 | 12/1986 | Kramer et al. | 367/1 |
| 4,982,385 | 1/1991 | Eynck | 367/162 |
| 5,420,825 | 5/1995 | Fischer et al. | 367/1 |

FOREIGN PATENT DOCUMENTS

| | | |
|---|---|---|
| 0114764 | 8/1984 | European Pat. Off. . |
| 2691596 | 11/1993 | France . |

*Primary Examiner*—Ian J. Lobo

*Attorney, Agent, or Firm*—Oblon, Spivak, McClelland, Maier & Neustadt, P.C.

[57] ABSTRACT

An absorbent passive acoustic antenna, designed to be attached to the hull of a ship, is made in the form of a stack of layers of polyurethane having different types of composition to obtain absorbent and/or reflective characteristics so as to minimize the parasitic signals received by the hydrophones and achieve the maximum absorption of the signals coming from the active sonars external to the vessel on which these antennas are placed.

15 Claims, 3 Drawing Sheets

ABSORBENT PASSIVE ACOUSTIC ANTENNA

BACKGROUND OF THE INVENTION

1. The present invention relates to absorbent, acoustic passive antennas that can be used to receive the acoustic signals in order to convert them into electrical signals to be processed and, at the same time, to absorb these very same acoustic signals, especially when they come from an active detection sonar. It can be applied more particularly to antennas having large surface areas, designed to be fixed with a shape matching that of the hull of a ship.

2. Description of the Prior Art

For some years now, acoustic antenna structures have been developed with large dimensions, for example several square meters. These antennas are called surface antennas. These antennas essentially use, as sensors, piezoelectric poller elements, generally of the PVF2 type. In view of these dimensions, it becomes necessary to fix the antennas to the hull of the boat bearing the sonar to which they are linked. These antennas are shaped so that they match the shape of the hull to which they are attached. Under these conditions, in order to ensure the performance characteristics of the system, it is essential to have control over three essential criteria:

- a hydrodynamic criterion to avoid lowering the performance characteristics of the carrier ship, this being achieved precisely by making an antenna with a matching shape;
- an acoustic barrier criterion to obtain an efficient rejection of noises coming from the rear of the antenna, hence from the carrier boat, to avoid masking the useful signals;
- a criterion of anechoic quality to absorb the acoustic signals at the frequencies used by underwater weapons such as torpedoes by using precisely the fact that the surface area of the hull covered by the antennas is great.

It will be noted however that these criteria may be met with standard localized sensors, and not by the use of a piezo-electrical polymer, when the frequencies used exceed one or two kHz, provided however that the matching shape of the antenna is maintained. This is relatively difficult with a large number of small sensors, made of ceramic for example.

In a French patent application No. 92 06274 filed on 22nd May 1982 and delivered on 26th Nov. 1993 under U.S. Pat. No. 2,691,569, (corresponding to U.S. Pat. No. 5,517,467) the present applicant has described a antenna for submarines that has a matching shape and that essentially meets the hydrodynamic criterion described here above.

There also exist known "soft" acoustic reflectors designed to be placed in the rear of the cylindrical antennas, which are themselves located in the front of surface boats. Soft reflectors such as these are described especially in the French patent application No. 83 00753 filed by the applicant on 19th Jan. 1983 and delivered under U.S. Pat. No. 2,539,541. It is also the practice sometimes, in the place of these soft reflectors, to use hard type reflectors, namely high impedance reflectors.

The antennas that best meet the above-defined criteria are essentially devices designed to act as side antennas for high-tonnage antennas, the structure of which is defined in a sectional view in the appended FIG. 1.

The antenna is placed on the thick hull 101 of a submarine and comes into contact with water by means of intermediate apertures made in the thin hull 102 of this submarine.

The hydrophones 103, embedded in a protective layer, are fixed to the surface of a metal plate 104 that plays the role of a hard reflector and is flush with the thin hull 102.

This plate 104 is itself borne by compliant supports 105 which are furthermore fixed to the surface of the thick hull 101. These compliant supports demarcate an internal space 106 that has reflective and absorbent elements as described here below. The rest of this internal space 106 is filled with water.

In the cavity 106, there are therefore soft type absorbent reflectors 107 fixed to the lower face of the metal plate 104, and absorbent reflectors 108 formed by compliant tubes embedded in a soft matrix and fixed to the external surface of the thick hull.

The heterogeneity of such a structure implies that it is complicated to build and difficult to position on rounded hulls. Furthermore, the thickness of this antenna conventionally reaches 300 mm, which is considerable. These difficulties result in a high cost that becomes prohibitive.

SUMMARY OF THE INVENTION

To overcome these drawbacks, the invention proposes an absorbent acoustic antenna of the type comprising a set of sensors, notably flat sensors, designed to detect the acoustic waves, chiefly comprising a first layer of lightened elastomer forming an absorbent material, a second layer with high acoustic impedance forming a hard reflector and lying on the first layer, a third layer formed by a soft elastomer whose acoustic characteristics are close to those of water in order to be transparent to the acoustic waves, this third layer coating said sensors and lying on the second layer, and a fourth layer formed by a lighted elastomer to be anechoic by absorption at the high acoustic frequencies and transparent at the acoustic frequencies lower than these high acoustic frequencies, and lying on the third layer.

According to another characteristic, the first layer is made of polyurethane charged with air-filled micro-balloons;

According to another characteristic, the first layer is made of a rubber-cork composite material.

According to another characteristic, the second layer is made of polyurethane charged with a dense material.

According to another characteristic, the second layer is formed by a steel plate.

According to another characteristic, the third layer is made of polyurethane.

According to another characteristic, the fourth layer is made of polyurethane charged with air-filled micro-balloons.

According to another characteristic, the fourth layer is made of a rubber-cork composite material.

According to another characteristic, the composition of the first layer may be used to obtain a $\rho c$ product substantially three times lower than that of water and a tan $\delta$ value relative to the coefficient of dynamic compressibility substantially equal to 0.35, the Shore hardness of the third layer is lower than 50 A, and the fourth layer has a $\rho c$ product close to that of water and a tan $\delta$ value substantially equal to 0.2 to be anechoic at the frequencies higher than 20 kHz and transparent at the frequencies lower than 15 kHz.

According to another characteristic, the second layer is charged with balls made of a material chosen from among lead, steel and metallic materials with high acoustic impedance.

According to another characteristic, the first layer has a thickness substantially equal to 100 mm, the second layer has a thickness substantially equal to 15 mm, the third layer has a thickness substantially equal to 10 mm, and the fourth layer has a thickness substantially equal to 10 mm.

According to another characteristic, the antenna further comprises a fifth layer that lies on the fourth layer and is formed by an elastomer with a Shore hardness of over 70 A, its ρc product being close to that of water, to protect the other layers while at the same time being transparent to the acoustic waves.

According to another characteristic, the fifth layer has a thickness substantially equal to 5 mm.

According to another characteristic, the antenna has a thin sheath made of plastic that forms a vessel encasing the layers, the upper part of which is open to let through the acoustic waves.

According to another characteristic, the sensors are flat and of the surface type, made of piezoelectrical polymer.

BRIEF DESCRIPTION OF THE DRAWINGS

Other particular features and advantages of the invention shall appear clearly from the following description, given by way of a non-restrictive example and made with reference to the appended drawing, of which.

MORE DETAILED DESCRIPTION

Figure 2:
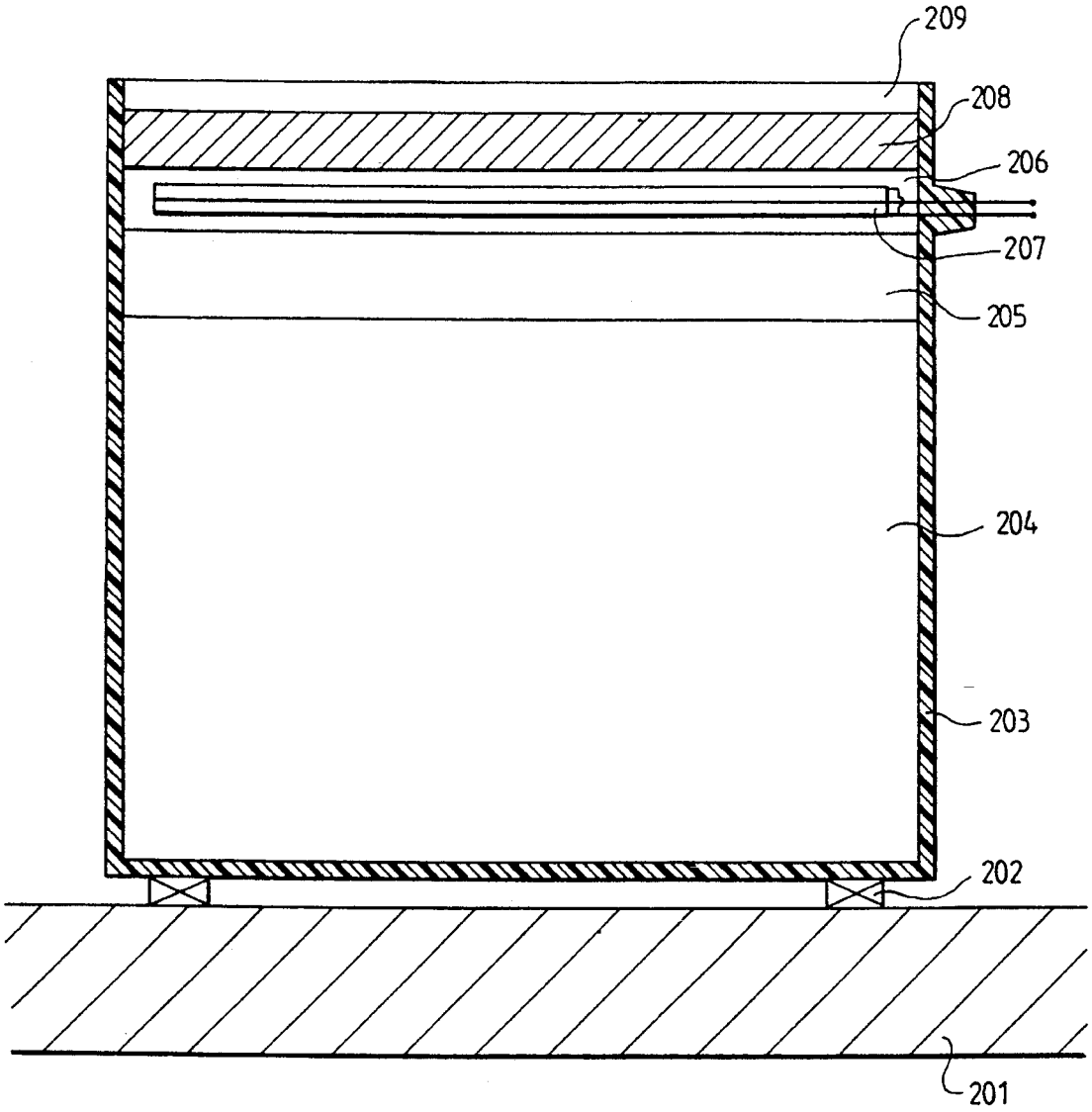
FIG. 2 shows a sectional view of an antenna according to the invention.

The device of FIG. 2 is fixed to the hull 201 of the carrier ship with shims 202 by means of which it is possible to let a sheet of water remain between the antenna and this hull. This makes it possible, firstly, to detach the antenna from the hull and, secondly, to obtain reproducible characteristics for the performance characteristics of the antenna.

The different layers of materials forming the antenna are contained in a protective sheath 203, formed for example by an elastomer or thermoplastic material with a small thickness, typically equal to 2 to 3 mm.

The different layers of materials contained in the sheath 203 are preferably all polyurethane-based. Their composition and treatment are different so as to give the desired characteristics described here below. It is indeed possible to control the manufacture of polyurethane to obtain characteristics according to techniques that are now well known in the prior art. However, in the case of a flat antenna, the hard reflector may advantageously be made of a steel plate.

The bottom of the sheath is filled with a layer 204 whose thickness is the greatest, 100 mm for example. This layer is advantageously made of a polyurethane charged with air-filled micro-balloons. The quantity of micro-balloons is adjusted so that the ρc product of the material is about three times lower than that of water, and so that the tan δ value relating to the coefficient of dynamic compressibility is about 0.35. These micro-balloons form a material that is well known and commercially available. However, this layer may also be formed by a rubber-cork material such as the one known by the commercial brand name NEBAR.

On this first layer, there is a second layer 205. It has a thickness, for example, of 15 mm formed by a polyurethane charged with homogeneously distributed beads of lead and steel. These beads could also be formed by a metallic material having a high acoustic impedance. Small-sized beads such as these are also well known in the prior art. This layer could also be formed by a steel plate when the flat antenna is designed to be placed on a relative flat hull and when therefore the antenna is subjected to little shaping.

A third layer 206 is used essentially to hold and protect the surface hydrophones 207 that constitute the reception elements of the antenna. This layer, which has a thickness of 10 mm for example, is formed by a soft polyurethane whose Shore hardness does not exceed 50 A and whose acoustic characteristics, especially the ρc product and the Poisson's coefficient, are close to those of water so that it is essentially transparent to acoustic waves.

A fourth layer 208, which is 10 mm thick for example, covers the third layer and is formed by a polyurethane charged with micro-balloons. The ρc product of this fourth layer is close to that of the water and its tan δ value is chosen so that the layer is firstly anechoic at the higher frequencies corresponding to those of the active detection sonars and, secondly, transparent at the lower frequencies which have to be detected by the hydrophones 207. For example, tan δ could be on the order of 0.2 to obtain a level of anechoic quality by absorption of over 20 kHz and transparency below 15 kHz. The layer may also be constituted by NEBAR.

A fifth layer 209, with a thickness of 5 mm for example, covers the fourth layer to close the sheath 203 and is thus used to protect all the other layers. This layer is formed by a material, a polyurethane for example, whose Shore hardness is over 70 A in order to withstand abrasion and whose ρc product is close to that of water so that it can transmit the acoustic waves received from the marine environment in which the antenna is plunged to the lower layers.

The unit constituted formed by the first layer 204 forming an absorber and the second layer 205 forming a hard reflector constitutes a elastic-mass system. This fact enables a study of the thickness of these two layers to obtain a damping of the resonances that arise between the hydrophones and the hull. Furthermore, the first layer 204 also enables the absorption of the resonances that form in the sheet of water between the sheath 203 and the layer 201, owing to the presence of the two hard reflectors, one corresponding to the hull and the other to the second layer 205.

Figure 1:
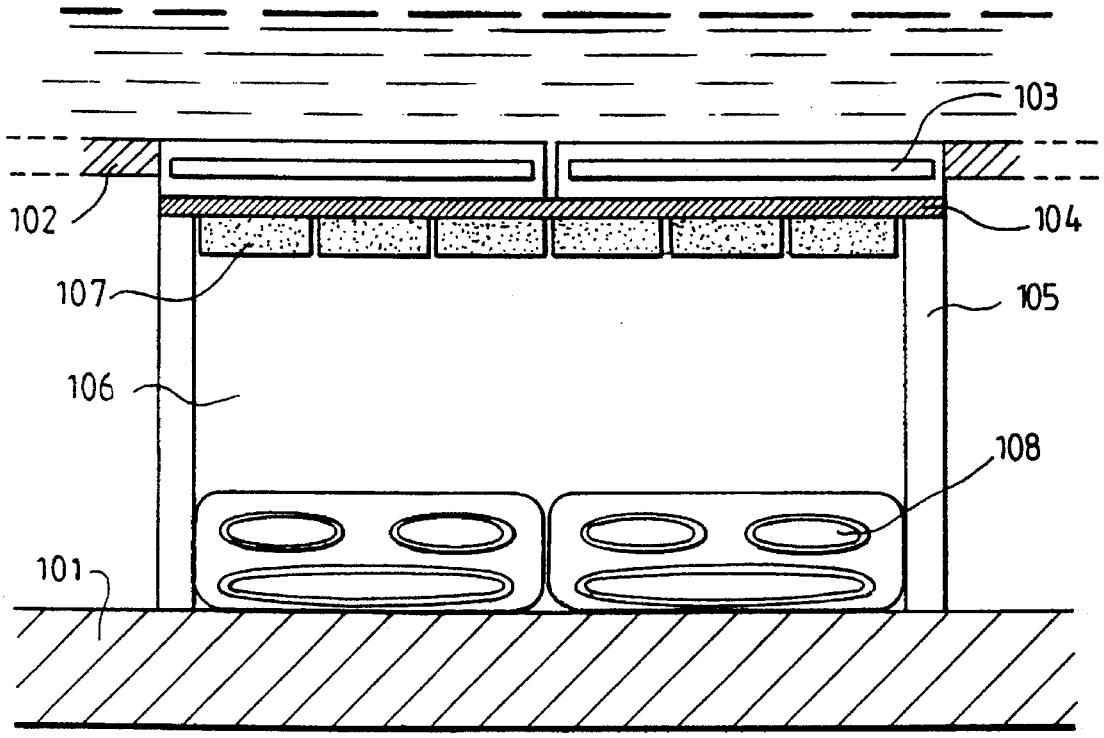
FIG. 1 PRIOR ART
FIG. 1 shows a sectional view of a prior art antenna.

The antenna module thus obtained therefore has a total height of about 150 mm, which must be compared with the 300 mm generally required for the manufacture of a structure such as the one of FIG. 1. The static compressibility of this module at 50 bars is about 6%, and its surface weight in water is about 120 daN/m$^2$.

The manufacture of such a module starts with the manufacture, by molding and calendering for example, of the polyurethane plates whose composition corresponds to those described here above for the layers 204, 205 and 208. These plates are then cut out to form blocks corresponding to the internal sizes of the sheath 203.

This sheath has itself been obtained by molding in an appropriate mold, and after the preparation of the internal surface of this sheath, by scraping for example, the first two blocks corresponding to the layers 204 and 205 are positioned.

The hydrophones 207 are then placed on the surface of the layer 205. They are kept in position by shims formed by small pieces of material constituting the layer 206, obtained for example from scraps from a manufacturing operation. After these hydrophones have been wired to a side connector, the polyurethane designed to form the layer 206 is cast. This makes it possible to coat the hydrophones.

When this layer 206 is polymerized, the block forming the layer 208 is positioned. Then the protective layer 209 is cast to finish the manufacture of the module.

Should the second plate 205 be formed by a steel plate, it will be first of all placed in a mold open on both sides. The upper layers will then be cast. Then the mold will be turned over, and finally the lower layer will be cast. It is also possible to carry out the operation in reverse by casting first of all the lower layer.

A particular embodiment of such a module used a network of 16 hydrophones made of PVF2 forming 75 mm ×75 mm squares placed in a 4×4 network. The total dimensions of the module were 300 mm ×400 mm ×150 mm, corresponding to a weight of 50 kilograms. This makes it quite possible to perform handling operations without special means.

After these modules have been fixed to a 65 mm hull by means of metal flanges, in interposing elastomer pads 102 to obtain a 5 mm thick sheet of water between the hull and the module, this unit was placed in a water-filled vessel and measurements were made. The results of these measurements correspond to the curves of the FIGS. 3 and 4.

Figure 3:
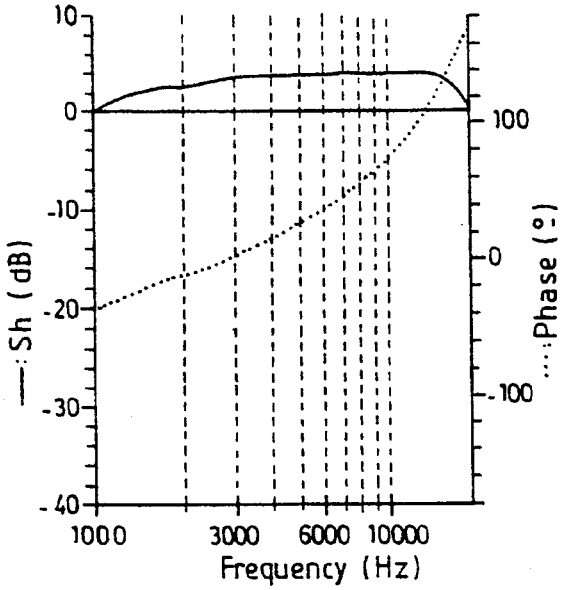
FIGS. 3 to 6 show characteristic curves of certain important parameters of this antenna.

FIG. 3 shows the hydrophonic sensitivity under pressure in relative value with respect to the value of the pressure in a free field for a wave in normal incidence, namely:

$$Sh = 20 \log \left( \frac{P\text{total}}{P\text{incident}} \right)$$

Sh is in decibels and the phase has also been represented in degrees.

Figure 4:
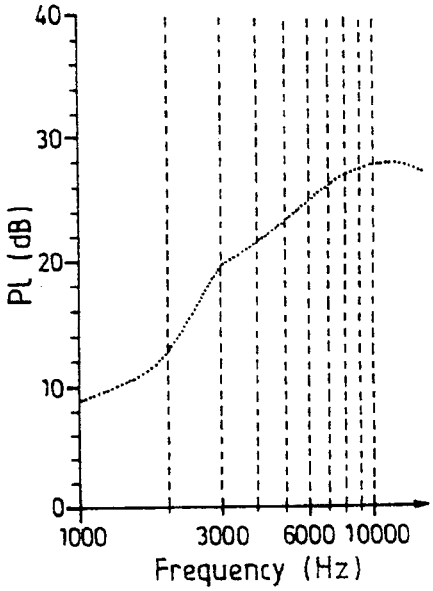

FIG. 4 shows the loss by insertion, i.e. the "rear" Sh and is given for a wave coming from the rear by $$Pi = \left( \frac{P\text{incident}}{P\text{total}} \right)$$

Figure 5:
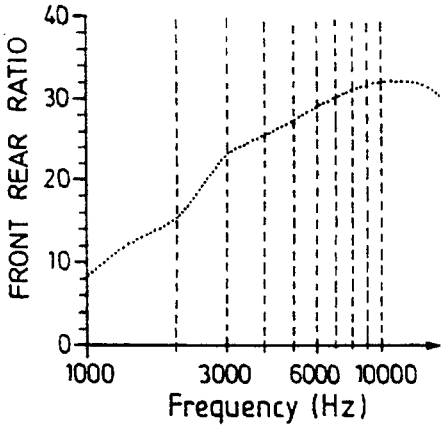

FIG. 5 shows the front/rear ratio, namely:

Sh front—Sh rear

Figure 6:
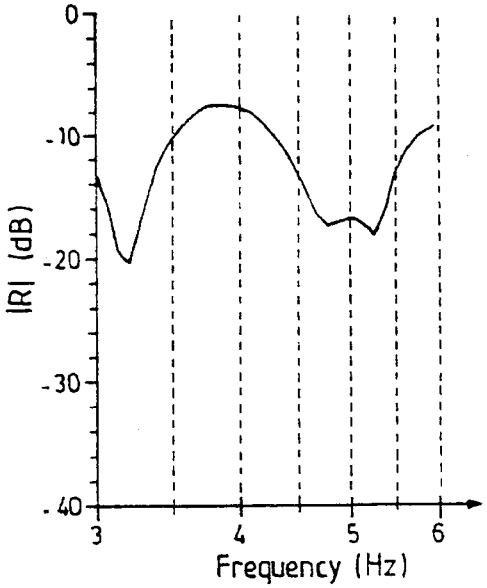

FIG. 6 finally shows the modulus |R| of the coefficient of reflection. It is observed that the curve is fairly irregular and has holes. The explanation thereof is that the material foxing the layer 209 in the embodiment measured does not quite have a value of the ρc product that is identical to that of water. It is possible to improve matters by adjusting this parameter more precisely.

The experiments have shown that the structure thus described for such an antenna has performance characteristics substantially independent of the choice of the transducers 207. Thus, in another embodiment using cylindrical ceramic hydrophones with a diameter of 10 mm and a length of 25 mm, performance characteristics substantially equivalent to those described here above have been obtained.

Obviously, numerous modifications and variations of the present invention are possible in light of the above teaching. It is therefore to be understood that within the scope of the appended claims, the invention may be practiced otherwise than as specifically described herein.

What is claimed is:

1. An absorbent acoustic antenna, which comprises a set of sensors detecting acoustic waves, said antenna comprising a first layer of an elastomer forming an absorbent material, a second layer with a high acoustic impedance forming a hard reflector and lying on the first layer, a third layer formed of an elastomer having acoustic characteristics which are substantially similar to that of water in order to be transparent to the acoustic waves, said third layer coating said sensors and lying on the second layer, and a fourth layer formed of an elastomer so as to be anechoic by absorption at the high acoustic frequencies and transparent at acoustic frequencies lower than the high acoustic frequencies, said fourth layer lying on the third layer.

2. An antenna according to claim 1, wherein the first layer comprises polyurethane charged with air-filled micro-balloons.

3. An antenna according to claim 1, wherein the first layer comprises a rubber-cork composite material.

4. An antenna according to claim 1, wherein the second layer comprises polyurethane charged with a dense material.

5. An antenna according to claim 1, wherein the second layer comprises a steel plate.

6. An antenna according to claim 1, wherein the third layer comprises polyurethane.

7. An antenna according to claim 1, wherein the fourth layer comprises polyurethane charged with air-filled micro-balloons.

8. An antenna according to claim 1, wherein the fourth layer comprises a rubber-cork composite material.

9. An antenna according to claim 1, wherein the composition of the first layer may be used to obtain a ρc product substantially three times lower than that of water and a tan δ value relative to the coefficient of dynamic compressibility substantially equal to 0.35, the Shore hardness of the third layer is lower than 50 A, and the fourth layer has a ρc. product substantially similar to that of water and a tan δ value substantially equal to 0.2 so as to be anechoic at the frequencies higher that 20 kHz and transparent at the frequencies lower than 15 kHz.

10. An antenna according to claim 1, wherein the second layer is charged with balls made of a material chosen from among lead, steel and metallic materials with high acoustic impedance.

11. An antenna according to claim 1, wherein the first layer has a thickness substantially equal to 100 mm, the second layer has a thickness substantially equal to 15 mm, the third layer has a thickness substantially equal to 10 mm, and the fourth layer has a thickness substantially equal to 10 mm.

12. An antenna according to claim 1, which comprises a fifth layer that lies on the fourth layer and is formed by an elastomer with a Shore hardness of over 70 A, said fifth layer having a ρc product substantially similar to that of water, so as to protect the other layers while at the same time being transparent to the acoustic waves.

13. An antenna according to claim 12, wherein the fifth layer has a thickness substantially equal to 5 mm.

14. An antenna according to claim 1 which comprises a thin sheath made of plastic that forms a vessel encasing the layers, the upper part of which is open to let through the acoustic waves.

15. An antenna according to claim 1, wherein the sensors are flat and comprise surface type sensors, made of a piezo-electrical polymer.

* * * * *